US011859371B2

(12) United States Patent
Lehto

(10) Patent No.: US 11,859,371 B2
(45) Date of Patent: Jan. 2, 2024

(54) WEAR PART, BUCKET, SYSTEM AND METHOD

(71) Applicant: SANDVIK MINING AND CONSTRUCTION OY, Tampere (FI)

(72) Inventor: Tony Lehto, Turku (FI)

(73) Assignee: Sandvik Mining and Construction Oy, Tampere (FI)

( * ) Notice: Subject to any disclaimer, the term of this patent is extended or adjusted under 35 U.S.C. 154(b) by 419 days.

(21) Appl. No.: 17/265,261

(22) PCT Filed: Aug. 5, 2019

(86) PCT No.: PCT/EP2019/071015
§ 371 (c)(1),
(2) Date: Feb. 2, 2021

(87) PCT Pub. No.: WO2020/025831
PCT Pub. Date: Feb. 6, 2020

(65) Prior Publication Data

US 2021/0310220 A1 Oct. 7, 2021

(30) Foreign Application Priority Data

Aug. 3, 2018 (EP) ..... 18187304

(51) Int. Cl.
*E02F 9/28* (2006.01)
*E02F 3/40* (2006.01)

(52) U.S. Cl.
CPC ..... *E02F 9/2883* (2013.01); *E02F 3/40* (2013.01); *E02F 9/2816* (2013.01); *E02F 9/2858* (2013.01)

(58) Field of Classification Search
CPC ..... E02F 9/2883; E02F 3/40; E02F 9/2816; E02F 9/2858
See application file for complete search history.

(56) References Cited

U.S. PATENT DOCUMENTS 1,963,847 A * 6/1934 Jersey ..... E02F 3/40 37/446
3,497,973 A 3/1970 Campbell
3,845,578 A * 11/1974 Holmstrom ..... E02F 9/2833 403/380

(Continued)

FOREIGN PATENT DOCUMENTS

CN 106661860 A 5/2017
CN 108291393 A 7/2018

(Continued)

*Primary Examiner* — Adam J Behrens
*Assistant Examiner* — Blake E Scoville
(74) *Attorney, Agent, or Firm* — Corinne R. Gorski

(57) ABSTRACT

A wear part, a bucket, bucket system and a method for attaching the wear part to the bucket are provided. The wear part includes a forward edge for intruding into a material to be handled by the bucket, and an engagement portion for engaging with an engagement edge of the bucket. The engagement portion has a concave cross section. A lever element extends from a side of the engagement portion in a direction backwards from the forward edge, and a fastening unit is arranged in a distal end of the lever element. The bucket has a plate hole arranged behind a bucket threshold in relation to an engagement edge for receiving a fastening element for fastening the wear part to the bucket.

13 Claims, 5 Drawing Sheets

(56) References Cited

U.S. PATENT DOCUMENTS

| | | | | |
|---|---|---|---|---|
| 4,120,105 | A | 10/1978 | Stepe | |
| 5,964,547 | A * | 10/1999 | Brinkley | E02F 9/2825 37/456 |
| 7,174,661 | B2 * | 2/2007 | Briscoe | E02F 9/2883 37/456 |
| 7,730,652 | B2 * | 6/2010 | McClanahan | E02F 9/2883 37/456 |
| 9,512,600 | B2 * | 12/2016 | Briscoe | E02F 9/2883 |
| 9,632,200 | B2 * | 4/2017 | Tasovski | H01Q 3/26 |
| 2005/0172524 | A1 * | 8/2005 | Grant | E02F 3/40 37/446 |
| 2007/0137071 | A1 * | 6/2007 | McClanahan | E02F 9/2833 37/452 |
| 2013/0047475 | A1 * | 2/2013 | Bierwith | E02F 9/2883 29/428 |
| 2017/0089045 | A1 * | 3/2017 | Dare | E02F 9/2833 |
| 2017/0284073 | A1 * | 10/2017 | Kunz | E02F 9/2883 |

FOREIGN PATENT DOCUMENTS

| | | | |
|---|---|---|---|
| WO | 2009082317 | A1 | 7/2009 |
| WO | 2017087273 | A1 | 5/2017 |

* cited by examiner

WEAR PART, BUCKET, SYSTEM AND METHOD

RELATED APPLICATION DATA

This application is a § 371 National Stage Application of PCT International Application No. PCT/EP2019/071015 filed Aug. 5, 2019 claiming priority to EP 18187304.3 filed Aug. 3, 2018.

BACKGROUND

The invention relates to a wear part for a bucket of a bucket machine.

The invention further relates to a bucket for a bucket machine.

The invention further relates to a bucket system.

The invention further relates to a method for attaching a wear part to a bucket.

A problem with known technology of wear parts and buckets is that the wear parts are complicated to attach to and especially remove from the bucket.

BRIEF DESCRIPTION

Viewed from a first aspect, there can be provided a wear part for a bucket of a bucket machine, the wear part comprising a forward edge for intruding in a material to be handled by the bucket, an engagement portion for engaging with an engagement edge of the bucket, the engagement portion comprising a concave cross section that consist of contact points arranged on a periphery of a circular arch, a lever element extending from a side of the engagement portion in a direction backwards from the forward edge, a fastening unit being arranged in a distal end of the lever element, the fastening unit comprising a raised surface that creates a protrusion extending from the surface of the lever being on the same side as the engagement portion, the fastening unit further comprising a wear part hole for receiving a fastening element for fastening the wear part to the bucket, the wear part hole extending from the raised surface to a surface of the lever element being on opposite side of the lever element as the engagement portion, and the fastening unit being adapted to make a tightening structure such that, in use, a force effecting the wear part in direction backwards from the engagement portion will occur.

Thereby a wear part easy to change may be achieved.

Viewed from a further aspect, there can be provided a bucket for a bucket machine, comprising an attachment system for attaching one or more wear parts to the bucket, the attachment system comprising an engagement edge arranged to extend along a front edge of a front plate of the bucket for receiving an engagement portion of the wear part, the engagement edge comprising a convex cross section that consist of contact points arranged on a periphery of a circular arch, the attachment system further comprising a backwardly directed bucket threshold arranged in the front plate, on a first side thereof and a distance from the front edge of the plate, and the bucket having a plate hole arranged behind the bucket threshold in relation to the engagement edge and for receiving a fastening element for fastening the wear part to the bucket, the plate hole extending from the first side to the second side of the plate.

Thereby a bucket where changing of a wear part is easy may be achieved.

Viewed from a further aspect, there can be provided a bucket system, comprising the bucket as described above and at least one wear part as described above, wherein a first distance from the backwardly directed bucket threshold to the engagement edge being dimensioned in relation to a length of the lever element of the wear part, such that, in use, when the wear part being attached to the bucket, a spanning force effecting in the wear part to a direction backwards from the engagement edge will occur.

Thereby a bucket system wherein the forces affecting to the wear part are evenly distributed may be achieved.

Viewed from a still further aspect, there can be provided a method for attaching the wear part as described above to the bucket as described above, the method comprising: fitting the engagement portion of the wear part around the engagement edge of the bucket, rotating the lever element against the first side of the front plate, finalizing the rotation by arranging the fastening unit of the wear part back of the bucket threshold of the bucket, fastening the wear part to the bucket by tightening the fastening element in the wear part hole and the plate hole, and creating a spanning force effecting in the wear part to a direction backwards from the engagement edge.

Thereby an easy and fast method may be achieved.

Inventive embodiments are also disclosed in the specification and drawings of this patent application. The inventive content of the patent application may also be defined in other ways than defined in the following claims. The inventive content may also be formed of several separate inventions, especially if the invention is examined in the light of expressed or implicit sub-tasks or in view of obtained benefits or benefit groups. Features of the different embodiments of the invention may, within the scope of the basic inventive idea, be applied to other embodiments.

In one embodiment, the engagement portion comprises a cross section that has a shape of a circular arch.

An advantage is that the shape facilitates releasing the wear part from the bucket since the engagement portion does not seize in the bucket.

In one embodiment, about 30%-100% of the length of the engagement portion has a shape of a circular arch.

An advantage is that forces affecting from the wear part the bucket may be dispersed on a large area.

In one embodiment, the wear part hole is arranged to end in a recess in said opposite surface.

An advantage is that a fastening element arranged in the wear part hole may be well protected.

In one embodiment, the fastening unit comprises a wedge surface extending from the side of the lever element being on the same side as the engagement portion, in a direction backwards, and the wedge surface ending to the raised surface.

An advantage is that tightening the fastening element may cause the engagement portion of the wear part to press tightly against the engagement edge.

In one embodiment, the wear part comprises a wedge piece attached movably next to the raised surface, and comprising a counter-wedge surface being at least essentially parallel with and arrangeable against the wedge surface, the wedge piece further comprising a contact surface for receiving a tightening element for tightening the counter-wedge surface against the wedge surface.

An advantage is that a force tightening the wear part against the engagement edge may be achieved.

In one embodiment, the wedge surface has an angle C of 95° to 120°, preferably 98° to 105°, in relation to the lever element.

An advantage is that the pressing of the engagement portion tightly against the engagement edge may be optimized.

In one embodiment, the wear part comprises a spring element adapted in the surface of the lever element being on the same side as the engagement portion, the spring element arranged against the raised surface, and comprising a contact surface for receiving a tightening element for tightening the spring element between the raised surface and the bucket such that, in use, a force effecting the wear part in direction backwards from the engagement portion will occur.

An advantage is that a force tightening the wear part against the engagement edge may be achieved.

In one embodiment, the shape of the lever element tapers from the engagement portion towards the fastening unit.

An advantage is that a lighter construction may be achieved.

In one embodiment, the engagement edge of the bucket comprises a cross section that has a shape of a circular arch.

An advantage is that the shape may carry forces not only in backwards direction, but also upwards and downwards directions.

In one embodiment, the bucket threshold 22 has an angle G of 95° to 110°, preferably 98° to 108°, in relation to the front plate 17.

An advantage is that the pressing of the engagement portion tightly against the engagement edge may be optimized.

In one embodiment, the bucket comprises a tightening element extending through the front plate, in an area between the fastening element and the engagement edge.

An advantage is that the wedge piece or the spring element may be affected easily from other side of the front plate.

BRIEF DESCRIPTION OF FIGURES

Some embodiments illustrating the present disclosure are described in more detail in the attached drawings, in which.

In the figures, some embodiments are shown simplified for the sake of clarity. Similar parts are marked with the same reference numbers in the figures.

DETAILED DESCRIPTION

Figure 1:
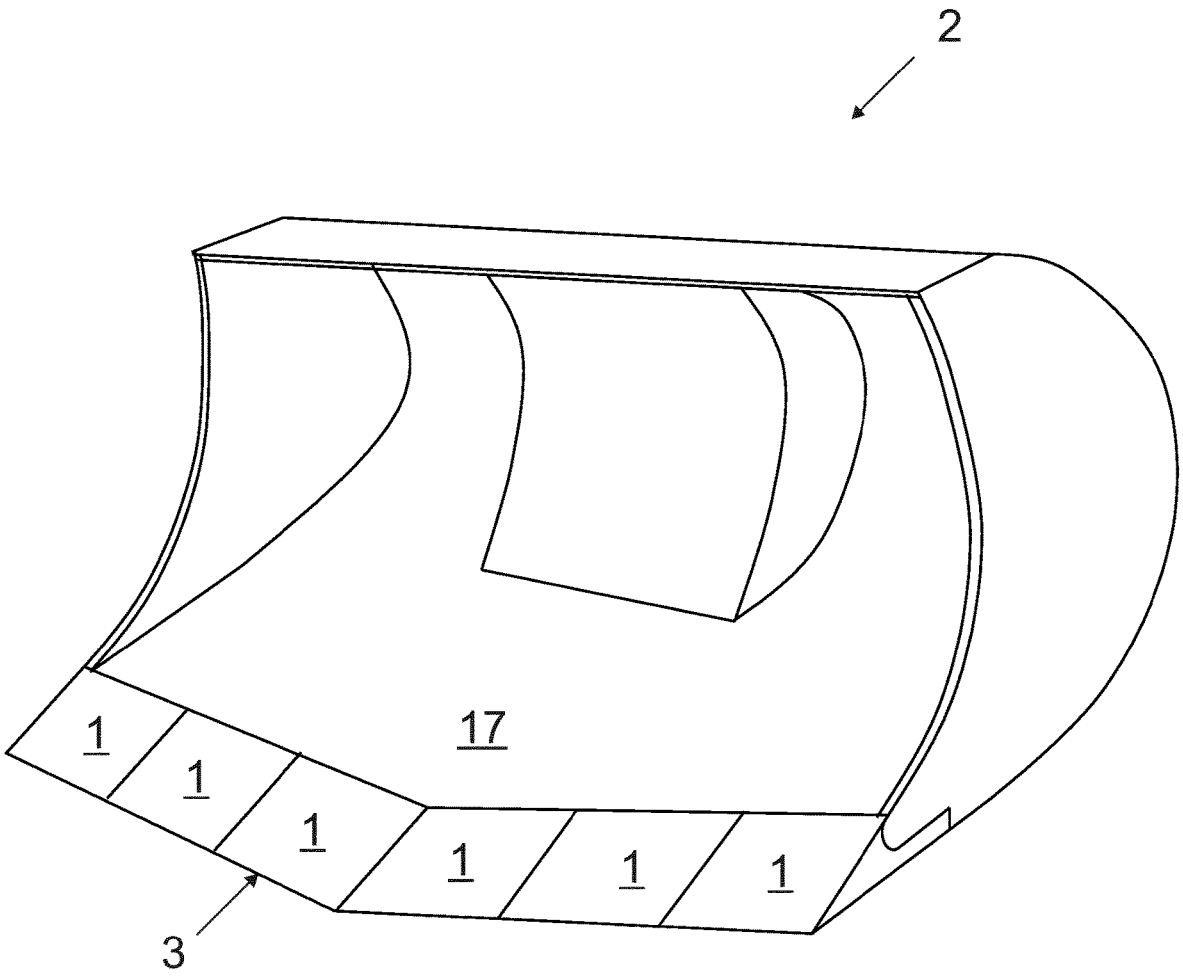
FIG. 1 is a schematic view of a bucket system comprising a bucket and wear parts attached therein.

FIG. 1 is a schematic view of a bucket system comprising a bucket and wear parts attached therein.

Buckets 2 comprises typically plurality of wear parts 1. In the embodiment shown in FIG. 1, there are six wear parts 1 attached to the bucket 2. As shown, the wear parts 1 may be arranged side by side so that a continuous lip or shroud of wear parts is constituted. In another embodiment, there are tooth arranged at the front edge of the bucket 2, and the wear parts 1 are arranged therebetween.

All the wear parts 1 of a bucket 2 may have same shape and dimensions. Alternatively, there are differently shaped and/or dimensioned wear parts 1.

In the embodiment shown in FIG. 1, forward edges 3 of the wear parts constitutes a V-shaped design (seen from above). Alternatively, the shape may be straight, curved or any combinations of said shapes.

Figure 2A:
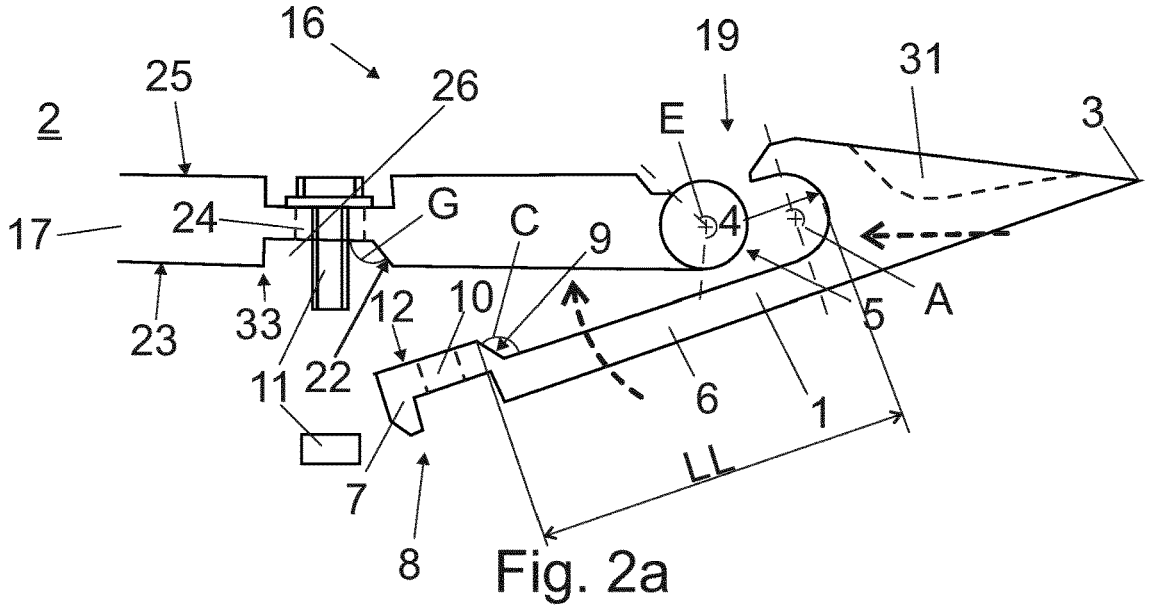
FIG. 2*a* is a schematic side view of another bucket system and method for attaching the wear part to the bucket in partial cross-section.
Figure 2B:
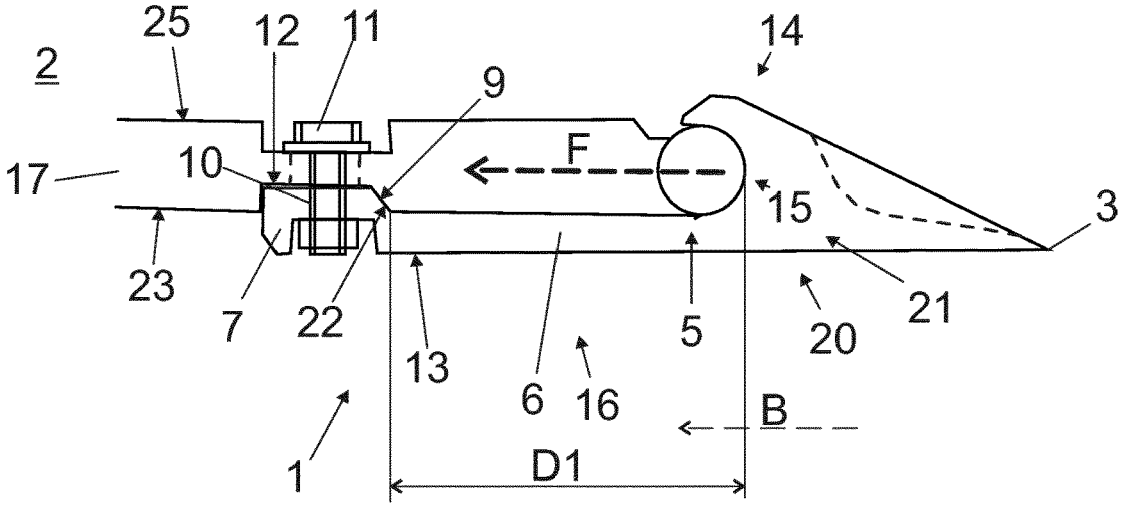
FIG. 2*b* is a schematic side view of the bucket system and method shown in FIG. 2*a*.
Figure 2C:
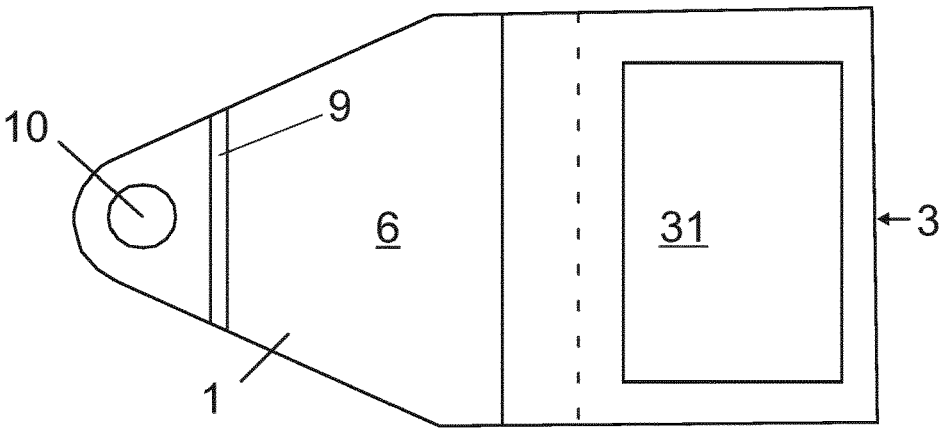
FIG. 2*c* is a schematic top view of the wear part shown in FIG. 2*a*.

FIG. 2*a* is a schematic side view of a detail of another bucket system and method for attaching the wear part to the bucket in partial cross-section, FIG. 2*b* is a schematic side view of the bucket system and method shown in FIG. 2*a*, and FIG. 2*c* is a schematic top view of the wear part shown in FIG. 2*a*.

The wear part 1 comprises a forward edge 3 for intruding in a material to be handled by the bucket. The wear part 1 may comprise at least one pocket 31 that reduces the weight of the wear part 1.

Furthermore, the wear part 1 comprises an engagement portion 4 for engaging with an engagement edge 5 of the bucket 2. The engagement portion 4 comprises a concave cross section 14 that consist of contact points 15 arranged on a periphery of a circular arch. In the embodiment shown in Figures, the engagement portion 4 has a cross section that has a shape of a circular arch in all the length of the engagement portion 4. In another embodiment, not all the length has a shape of a circular arch, nonetheless the engagement portion 4 comprises a cross section that has a shape of a circular arch. According to an idea, 30%-100% of the length of the engagement portion 4 has a shape of a circular arch. In an embodiment, the engagement portion 4 comprises e.g. a wear indicator the shape of which does not follow a shape of circular arch.

In still another embodiment, the cross sectional shape of the engagement portion 4 is not a circular arch, but it consists of contact points 15 arranged on a periphery of a circular arch. According to an idea, the engagement portion 4 comprises ridges the apexes of which are arranged on a periphery of (an imaginary) circular arch.

The circular arch has an angle A in its centre point. In the shown embodiment, angle A is about 180°, but the angle may, of course vary.

The wear part 1 comprises a lever element 6 extending from a side of the engagement portion 4 (that is an underside of the wear part 1 in the shown embodiment) in a direction backwards B from the forward edge 3. In the embodiment shown in Figures, the shape of the lever element 6 tapers from the engagement portion 4 towards the fastening unit 7. However, the shape of the lever element 6 may vary.

In a distal end 8 of the lever element 6 there is arranged a fastening unit 7 that comprises a raised surface 12. The raised surface 12 creates a protrusion extending from the surface of the lever 6 that is on the same side as the engagement portion 4 (that is an upper side in the shown embodiment).

Furthermore, the fastening unit 7 comprises a wear part hole 10 for receiving a fastening element 11 that fastens the wear part 1 to the bucket 2. In another embodiment, there may be more than one wear part hole 10, e.g. two or three. The wear part hole 10 extends from the raised surface 12 to an opposite surface 13 of the lever element 6.

In the shown embodiment the wear part hole 10 ends in a recess 26 in said opposite surface 13. The recess may give protection for the fastening element 11, especially if a nut is used in the fastening element.

According to an aspect of the invention, the fastening unit 7 comprises a wedge surface 9 arranged on the side of the lever element 6 being on the same side as the engagement portion 4 (that is an upper side in the shown embodiment). The wedge surface 9 extends in the direction backwards B, and ends to the raised surface 12. In an embodiment, the wedge surface 9 has an angle C of 95° to 120°, preferably 98° to 105°, in relation to the lever element 6.

The bucket system further comprises a bucket 2. The bucket 2 has attachment means in order to attaching the bucket 2 in a bucket machine (not shown).

The bucket 2 comprises an attachment system 16 for attaching one or more wear parts 1 to the bucket 2. The attachment system 16 receives an engagement portion 4 of the wear part. The attachment system 16 comprises an engagement edge 5 arranged to extend along a front edge 19 of a front plate 17 of the bucket. The front edge 19 may be straight through all its length, or it may have at least one discontinuity where the direction of the front edge 19 changes. Thus the front edge 19 may have (seen from above) e.g. V-shape (spade), or combination of straight and spade designs. Furthermore, the front edge 19 may be a part of bucket body, or it may be arranged in a front edge plate that is attached to the bucket body by e.g. welding.

The engagement edge 5 comprises a convex cross section 20 that consist of contact points 21 arranged on a periphery of a circular arch.

In the embodiment shown in Figures, the engagement edge 5 has a cross section that has a shape of a circular arch in all the length of the engagement portion 4. In the shown embodiment, the engagement edge 5 has been made of a round metal bar.

In another embodiment, not all the length has a shape of a circular arch, According to an idea, at least 30% of the length of the engagement edge 5 has a shape of a circular arch.

In still another embodiment, the cross sectional shape of the engagement portion 4 is not a circular arch, but it consists of contact points 15 arranged on a periphery of a circular arch. According to an idea, the engagement portion 4 comprises ridges the apexes of which are arranged on a periphery of (an imaginary) circular arch.

The circular arch has an angle E in its centre point. In the shown embodiment, angle E is about 230°, but the angle may, of course vary.

The attachment system 16 further comprises a backwardly directed bucket threshold 22 arranged on a first side 23 of the front plate (an underside thereof in the shown embodiment) and a distance from the front edge 19, and a plate hole 24 that is arranged behind the bucket threshold 22 in relation to the engagement edge 5.

The bucket threshold 22 has an angle 95° to 110°, preferably 98° to 108°, in relation to the front plate 17.

In the embodiment shown in Figures, the bucket threshold 22 constitutes a recess 26 on said first side 23 together with a counter threshold 33. However, in some another embodiments, there is no counter threshold 33. In an embodiment, the recess 26 is continuous along the width of the bucket 2. In another embodiment, there are plurality of separate recesses 26 arranged parallel in the bucket 2.

The plate hole 24 receives the fastening element 11 already disclosed in this description. The plate hole 24 extends from the first side 23 to the second side 25 of the plate. In an embodiment, the plate hole 24 has an elongated shape for giving some tolerance for fitting the plate hole 24 to the wear part hole 10. It is to be noted, that the plate hole 24 may have another shape, too.

According to an aspect of the invention, the bucket system is dimensioned so that a first distance D1 (measured as shown in FIG. 2*b*) from the backwardly directed bucket threshold 22 to the uttermost point of the engagement edge 5 is dimensioned in relation to a length LL (measured as shown in FIG. 2*a*) of the lever element 6 from the raised surface 12 to the bottom of the engagement portion 4 such that, when the wear part 1 is attached to the bucket 2, a spanning force F effecting in the wear part 1 to a direction backwards B from the engagement edge 5 will occur. In other words, the mounting bolt 11 pulls the wedge surface 9 towards the first side 23 of front plate and along the bucket threshold 22 such that the engagement portion 4 presses firmly against the engagement edge 5.

According to an aspect, the radius of the wear part arch and the bucket arch, or an imaginary arch thereof, shall be at least essentially equal. In an embodiment, said radiuses are equal. In another embodiment, the wear part arch is slightly smaller than that of the bucket arch, say e.g. 0.03 mm, in height direction (perpendicular to the front plate 17) of the radius.

According to an aspect, the wear part 1 is attached to the bucket 2 as follows:

1. The engagement portion 4 is fitted around the engagement edge 5 of the bucket 2. This step is facilitated if the angle E is at least equal to the angle A, but preferably more. In the shown embodiment, the angle E is about 230°, and the angle A about 180°.
2. The lever element 6 is turned against the first side 23 of the front plate 17.
3. The rotation is finalized by arranging the fastening unit 7 of the wear part 1 back of the bucket threshold 22 of the bucket 2.
4. The wear part 1 is fastening to the bucket 2 by tightening the fastening element 11 in the wear part hole 10 and the plate hole 24. As a result, a spanning force F is created, said force F effecting in the wear part 1 to the direction backwards B from the engagement edge 5.

The wear part 1, the bucket 2 and the bucket system has several advantages.

Firstly, the wedges 9 and 22 are introduced for carrying forces, and the fastening element 11 is affected only by a pulling force.

Secondly, the engagement portion 4 and the engagement edge 5 with their roundish shape distribute the force very evenly.

Figure 3A:
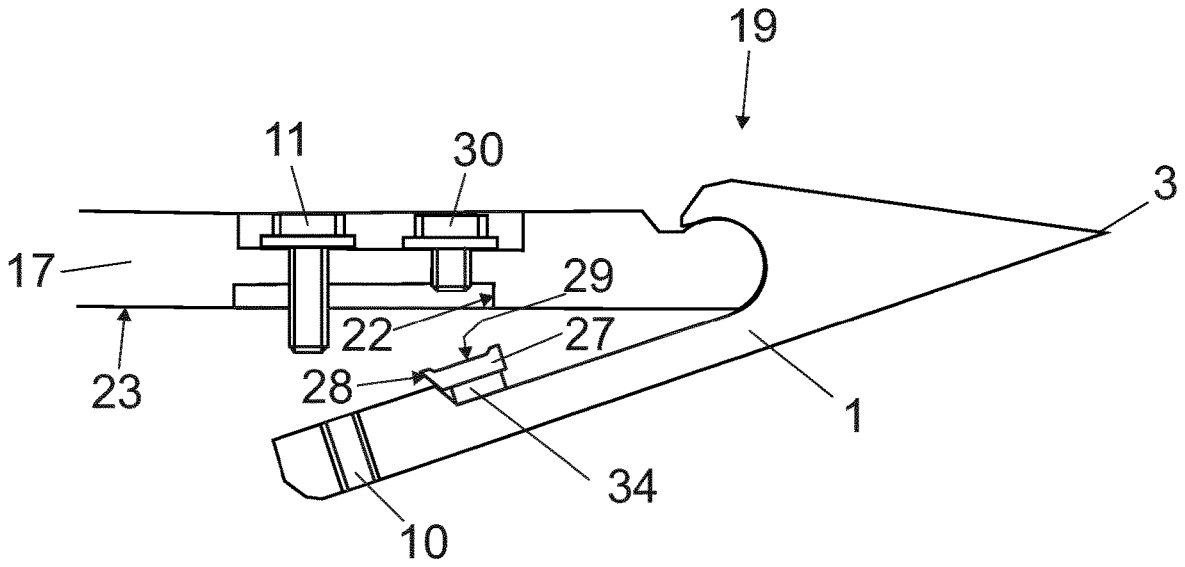
FIG. 3*a* is a schematic side view of third bucket system and method for attaching the wear part to the bucket in partial cross-section.
Figure 3B:
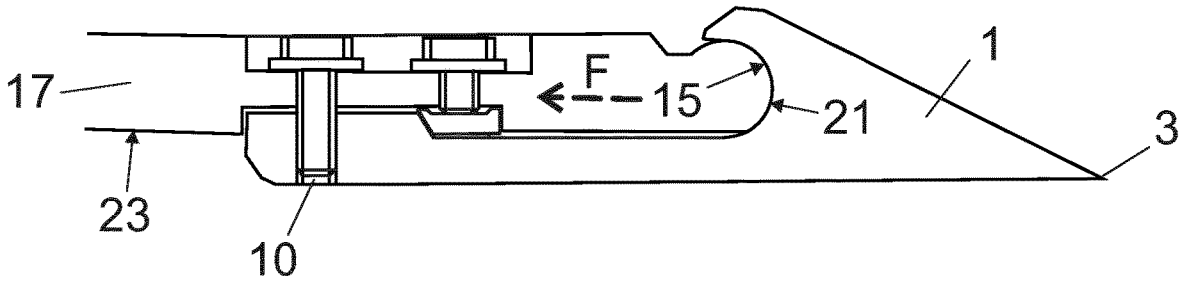
FIG. 3*b* is a schematic side view of the bucket system and method shown in FIG. 3*a*.

FIG. 3*a* is a schematic side view of third bucket system and method for attaching the wear part to the bucket in partial cross-section, and FIG. 3*b* is a schematic side view of the bucket system and method shown in FIG. 3*a*.

In this embodiment, the wear part 1 comprises a wedge piece 27 attached movably next to the raised surface 12. In an embodiment, the wedge piece 27 is attached by an elastic attaching element 34 to the wear part 1.

The wedge piece 27 comprises a counter-wedge surface 28 that is at least essentially parallel with and arrangeable against the wedge surface 9.

The wedge piece 27 comprises further a contact surface 29 for receiving a tightening element 30. Said tightening element 30 is used for tightening the counter-wedge surface 28 against the wedge surface 9. The tightening element 30 is adapted in a tightening hole that is arranged in an area between the fastening element 11 and the engagement edge 5, and extends through the front plate 17.

The wear part 1 is fastening to the bucket 2 by first tightening the fastening element 11 in the wear part hole 10 and the plate hole 24, and then tightening the tightening element 30 against the wedge piece 27. As a result, the wedge piece 27 is pushed against the wedge surface 9 and a spanning force F is created.

According to an idea, the bucket threshold 22 has an angle G that is at least about 60° in relation to the front plate 17. In the embodiment shown in FIGS. 3*a*, 3*b*, the angle $\alpha$ is 90°.

Figure 4A:
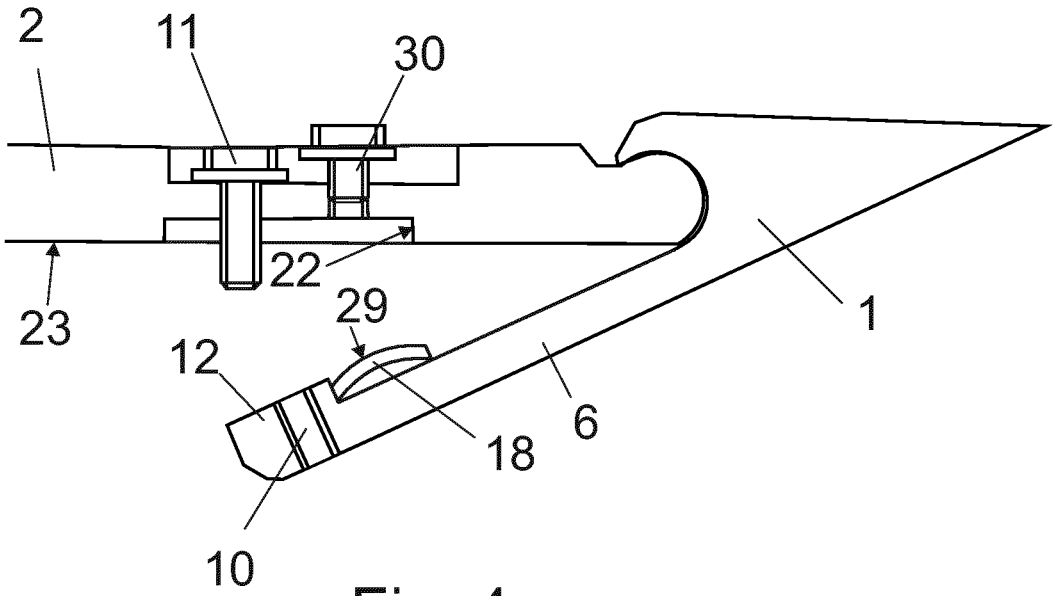
FIG. 4*a* is a schematic side view of fourth bucket system and method for attaching the wear part to the bucket in partial cross-section.
Figure 4B:
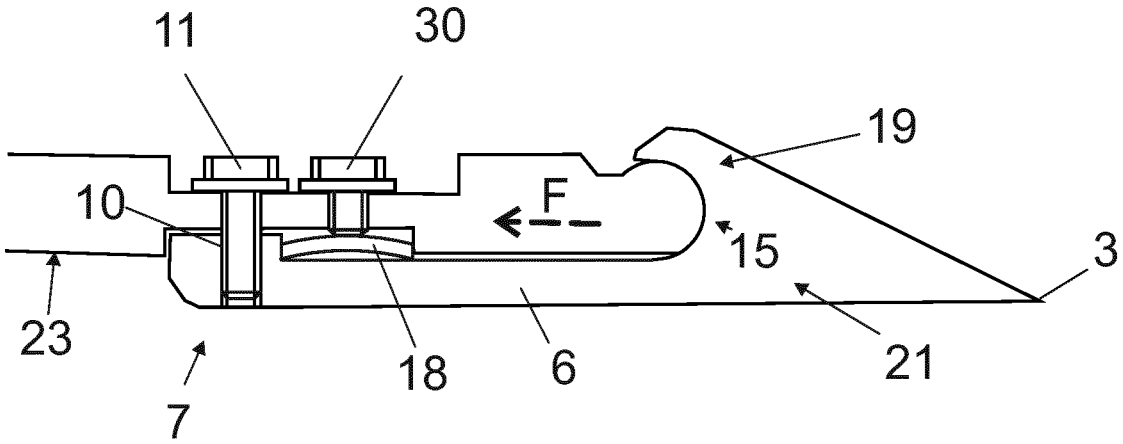
FIG. 4*b* is a schematic side view of the bucket system and method shown in FIG. 4*a*.

FIG. 4*a* is a schematic side view of fourth bucket system and method for attaching the wear part to the bucket in partial cross-section, and FIG. 4*b* is a schematic side view of the bucket system and method shown in FIG. 4*a*.

In an embodiment, the wear part 1 comprises a spring element 18 that is adapted in the surface of the lever element 6, on the same side as the engagement portion 4, and arranged against a the raised surface 12 (or a side thereof). The spring element 18 may be attached to the wear part 1 by e.g. glue or by some other attachment means that allows the spring element 18 extend along the lever element 6.

The spring element 18 comprises a contact surface 29 for receiving a tightening element 30 that is used for tightening the spring element 18 between the raised surface 12 and the bucket threshold 22. Following said tightening, a force effecting the wear part 1 in direction backwards B from the engagement portion 4 will occur.

The tightening element 30 may extend through the front plate 17 in an area between the fastening element 11 and the engagement edge 5.

Figure 5:
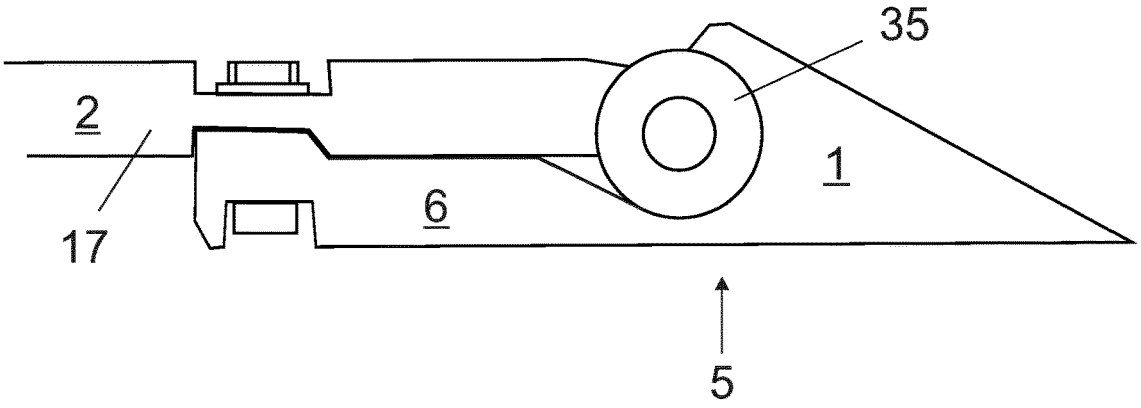
FIG. 5 is a schematic side view of fifth bucket system in partial cross-section.

FIG. 5 is a schematic side view of fifth bucket system in partial cross-section.

According to an aspect, the engagement edge 5 is construed form a bar 35, e.g. a round bar, welded to the front plate 17. In an embodiment, the diameter of the bar is about same as or smaller than the thickness of the front plate 17, or even smaller than said thickness. In another embodiment, such as shown in FIG. 5, the diameter of the bar 35 is essentially more than the thickness of the front plate 17.

The bar 35 may be hollow as shown in FIG. 5, or solid.

Figure 6:
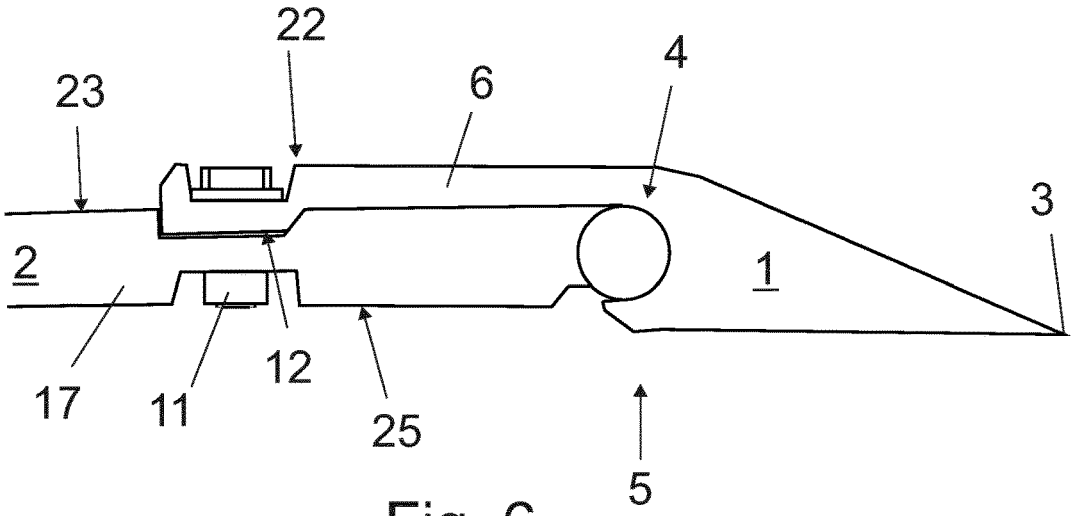
FIG. 6 is a schematic side view of sixth bucket system in partial cross-section.

FIG. 6 is a schematic side view of sixth bucket system in partial cross-section, showing an embodiment wherein the first side 23 of the front plate is the upper side thereof, and the lever element 6 with the raised surface 12 is arranged, correspondingly, on upper side of the engagement portion 4. The structure is thus reversed to those shown in the previous Figures. This embodiment may be advantageous in operations where the bucket 2 and the wear part 1 are susceptible for wearing mainly on upper-side of the front plate 17.

Figure 7:
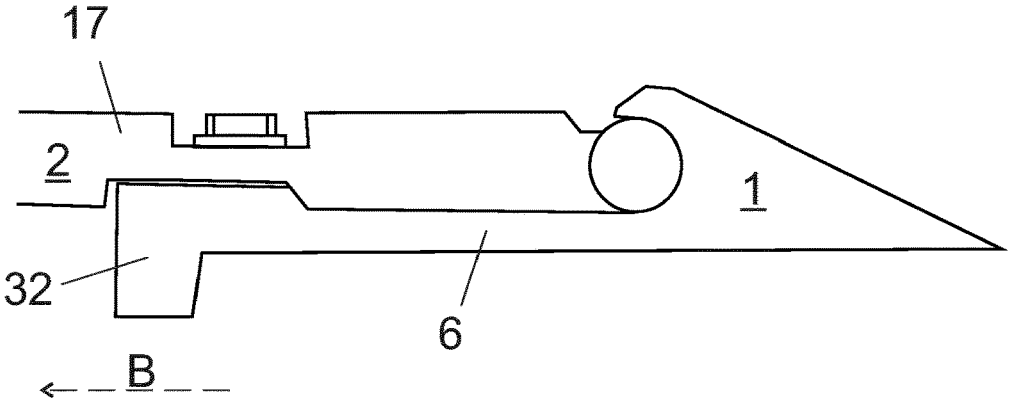
FIG. 7 is a schematic side view of seventh bucket system in partial cross-section.

FIG. 7 is a schematic side view of seventh bucket system in partial cross-section.

According to an aspect, a leveler 32 is arranged in or integrated to the wear part 1. In an embodiment, the lever 32 is an extension of the back edge of the lever element 6.

The lever 32 may be used for levelling e.g. ground as the bucket is moved in backwards direction B.

The invention is not limited solely to the embodiments described above, but instead many variations are possible within the scope of the inventive concept defined by the claims below. Within the scope of the inventive concept the attributes of different embodiments and applications can be used in conjunction with or replace the attributes of another embodiment or application.

The drawings and the related description are only intended to illustrate the idea of the invention. The invention may vary in detail within the scope of the inventive idea defined in the following claims.

REFERENCE SYMBOLS

1 wear part
2 bucket
3 forward edge
4 engagement portion
5 engagement edge
6 lever element
7 fastening unit
8 distal end
9 wedge surface
10 wear part hole
11 fastening element
12 raised surface of fastening unit
13 opposite surface of fastening unit
14 cross section of engagement portion
15 contact point of engagement portion
16 attachment system
17 front plate
18 spring element
19 front edge
20 cross section of engagement edge
21 contact point of engagement edge
22 bucket threshold
23 first side of front plate
24 plate hole
25 second side of front plate
26 recess in bottom surface
27 wedge piece
28 counter-wedge surface
29 contact surface
30 tightening element
31 pocket
32 leveler
33 counter threshold
34 attaching element
35 bar
A angle of wear part arch
B backwards direction
C angle of wedge surface
D1 first distance
E angle of bucket arch
F spanning force
G angle of bucket threshold
LL length of lever element

The invention claimed is:

1. A wear part for a bucket of a bucket machine, the wear part comprising:

a forward edge arranged for intruding in a material to be handled by the bucket;

an engagement portion arranged for engaging with an engagement edge of the bucket, the engagement portion including a concave cross section formed by contact points arranged on a periphery of a circular arch;

a lever element extending from a side of the engagement portion in a direction backwards from the forward edge;

a fastening unit arranged in a distal end of the lever element, the fastening unit including a raised surface that creates a protrusion extending from a surface of the lever element disposed on a same side as the engagement portion, the fastening unit further having a wear part hole arranged for receiving a fastening element for fastening the wear part to the bucket, the wear part hole extending from the raised surface to a surface of the lever element located on an opposite side of the lever element as the engagement portion, and wherein the fastening unit is arranged to make a tightening structure such that, in use, a force effecting the wear part in a direction backwards from the engagement portion will occur, the fastening unit including a wedge surface extending from the side of the lever element being on the same side as the engagement portion, in the direction backwards, and the wedge surface ending at the raised surface; and a wedge piece attached movably next to the raised surface, and including a counter-wedge surface being at least essentially parallel with and arrangeable against the wedge surface, the wedge piece further including a contact surface arranged for receiving a tightening element for tightening the counter-wedge surface against the wedge surface.

2. The wear part as claimed in claim 1, wherein the cross section of the engagement portion has a circular arch shape along an entire length thereof.

3. The wear part as claimed in claim 1, wherein at least 30% of a length of the engagement portion has a circular arch shape.

4. The wear part as claimed in claim 1, wherein an end of the wear part hole is arranged in a recess in the surface of the lever element located on the opposite side of the engagement portion.

5. The wear part as claimed in claim 1, wherein the wedge surface has an angle of 95° to 120° in relation to the lever element.

6. The wear part as claimed in claim 1, further comprising a spring element arranged in the surface of the lever element on the same side as the engagement portion, the spring element being arranged against the raised surface, and having a contact surface arranged for receiving a tightening element arranged for tightening the spring element between the raised surface and the bucket, such that, in use, a force effecting the wear part in the direction backwards from the engagement portion will occur.

7. The wear part as claimed in claim 1, wherein a shape of the lever element tapers from the engagement portion towards the fastening unit.

8. A bucket for a bucket machine, the bucket comprising:

an attachment system arranged for attaching one or more wear parts according to claim 1 to the bucket, the attachment system including the engagement edge arranged to extend along a front edge of a front plate of the bucket for receiving the engagement portion of the respective wear part, the engagement edge having a convex cross section formed by contact points arranged on a periphery of a circular arch, the attachment system further including a backwardly directed bucket threshold arranged in the front plate on a first side thereof and at a distance from the front edge of the plate; and a plate hole arranged behind the bucket threshold in relation to the engagement edge and arranged for receiving the fastening element for fastening the wear part to the bucket, the plate hole extending from the first side to a second side of the plate.

9. The bucket as claimed in claim 8, wherein the cross section of the engagement edge has a circular arch shape.

10. The bucket as claimed in claim 8, wherein the bucket threshold has an angle of 95° to 110°, in relation to the front plate.

11. The bucket as claimed in claim 8, wherein the tightening element extends through the front plate, in an area between the fastening element and the engagement edge.

12. A bucket system comprising:

at least one wear part as claimed in claim 1; and a bucket for a bucket machine, the bucket including an attachment system arranged for attaching the at least one wear part to the bucket, the attachment system including the engagement edge arranged to extend along a front edge of a front plate of the bucket arranged for receiving the engagement portion of the at least one wear part, the engagement edge having a convex cross section formed by contact points arranged on a periphery of a circular arch, the attachment system further including a backwardly directed bucket threshold arranged in the front plate on a first side thereof and at a distance from the front edge of the plate, the bucket having a plate hole arranged behind the bucket threshold in relation to the engagement edge and arranged for receiving the fastening element arranged for fastening the at least one wear part to the bucket, the plate hole extending from the first side to a second side of the plate, wherein a first distance from the backwardly directed bucket threshold to the engagement edge being dimensioned in relation to a length of the lever element of the wear part, such that, in use, when the at least one wear part is attached to the bucket, a spanning force effects the wear part in direction backwards from the engagement edge.

13. A method for attaching at least one wear part to a bucket, the method comprising:

providing at least one wear part according to claim 1;

providing the bucket, the bucket including an attachment system arranged for attaching the at least one wear part to the bucket, the attachment system including the engagement edge arranged to extend along a front edge of a front plate of the bucket arranged for receiving the engagement portion of the at least one wear part, the engagement edge having a convex cross section formed by contact points arranged on a periphery of a circular arch, the attachment system further including a backwardly directed bucket threshold arranged in the front plate on a first side thereof and at a distance from the front edge of the plate, the bucket having a plate hole arranged behind the bucket threshold in relation to the engagement edge and arranged for receiving the fastening element arranged for fastening the at least one wear part to the bucket, the plate hole extending from the first side to a second side of the plate;

fitting the engagement portion of the at least one wear part around the engagement edge of the bucket;

rotating the lever element against the first side of the front plate;

finalizing the rotation by arranging the fastening unit of the at least one wear part at the back of the bucket threshold of the bucket;

fastening the at least one wear part to the bucket by tightening the fastening element in the wear part hole and the plate hole; and creating a spanning force effecting in the at least one wear part in the direction backwards from the engagement edge.

* * * * *